US007600476B1

(12) United States Patent
Baker et al.

(10) Patent No.: US 7,600,476 B1
(45) Date of Patent: Oct. 13, 2009

(54) GEOMETRIC/MECHANICAL APPARATUS TO IMPROVE WELL PERFORATOR PERFORMANCE

(75) Inventors: Ernest L. Baker, Wantage, NJ (US); Arthur S. Daniels, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 208 days.

(21) Appl. No.: 11/277,382

(22) Filed: Mar. 24, 2006

(51) Int. Cl.
*F42B 1/02* (2006.01)

(52) U.S. Cl. ..... 102/476; 102/306

(58) Field of Classification Search ..... 102/305–309, 102/476, 492, 493
See application file for complete search history.

(56) References Cited

U.S. PATENT DOCUMENTS 2,789,504 A * 4/1957 McCloud et. al. ..... 102/307
2,831,429 A * 4/1958 Moore ..... 102/307
2,839,997 A * 6/1958 Church et. al. ..... 102/307
2,935,020 A * 5/1960 Howard et. al. ..... 102/307
3,447,463 A * 6/1969 Lavine ..... 102/492
3,613,582 A * 10/1971 Levamaki et al. ..... 102/306
3,613,586 A * 10/1971 Talley et al. ..... 102/476
3,789,760 A * 2/1974 Griffith ..... 102/331
3,995,549 A * 12/1976 Mullen, Jr. ..... 102/476
4,004,518 A * 1/1977 Potteiger et al. ..... 102/495
4,034,673 A * 7/1977 Schneider, Jr. ..... 102/476
4,776,272 A * 10/1988 Lindstadt et al. ..... 102/307
5,551,346 A * 9/1996 Walters et al. ..... 102/476
5,619,008 A * 4/1997 Chawla et al. ..... 102/310
6,523,474 B2 * 2/2003 Parrott et al. ..... 102/312

* cited by examiner

*Primary Examiner*—Bret Hayes
(74) *Attorney, Agent, or Firm*—Henry S. Goldfine

(57) ABSTRACT

Shaped charges that generate fan-like jets can produce slotted holes in rock formations. A shaped charge includes a case having on open front end, an external surface and a longitudinal axis, all transverse cross-sections of the case being bi-symmetric; an explosive material disposed in the case, the case including at least one opening extending from the external surface to the explosive material for initiation of the explosive material; and a liner disposed over the explosive material; wherein a pair of substantially identical longitudinal slots are formed on the external surface, the longitudinal slots being about 180 degrees apart.

6 Claims, 2 Drawing Sheets

GEOMETRIC/MECHANICAL APPARATUS TO IMPROVE WELL PERFORATOR PERFORMANCE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to wells and in particular to initiating flow from a well.

To initiate the flow of oil and/or other materials in a well, a conventional shaped charge warhead (or perforator) is fired through the well casing, the cement sheath and into the earthen formation. A shaped charge device comprises a shaped charge liner backed by high explosives. When the explosives are detonated, the shaped charge device forms a high velocity forward moving penetrator or "jet" that is capable of deeply penetrating the targeted material.

Output of a well is dependent on several factors including the size of the hole made by the perforator, the hole shape and the penetration depth. Fracturing fluids are pumped into the hole to fracture the rock formation and special agents in the fluid hold the fractures open to allow flow. Small diameter holes (as produced by conventional shaped charges) have a tendency to clog with these agents. Currently available perforators are designed to produce deep penetration but with a very small diameter hole.

One method of increasing hole size uses multiple initiation points to alter the perforator jet output. This method requires significantly changing the current perforator manufacturing procedures, the perforator external hardware and the way the perforators are integrated into the holding apparatus. Other methods to alter jet output are being investigated. U.S. Pat. No. 6,925,924 issued on Aug. 9, 2005 includes a detailed description of the well perforation process and is incorporated by reference herein.

SUMMARY OF THE INVENTION

It is an object of the invention to provide an apparatus and method for increasing the size of holes created in well bores, for initiating material flow.

Another object of the invention is to provide a shaped charge that will produce a fan-like jet to create slotted holes in rock formations.

One aspect of the invention is a shaped charge comprising a case having an open front end, an external surface and a longitudinal axis, all transverse cross-sections of the case being bi-symmetric; an explosive material disposed in the case, the case including at least one opening extending from the external surface to the explosive material for initiation of the explosive material; and a liner disposed over the explosive material; wherein a pair of substantially identical longitudinal slots are formed on the external surface, the longitudinal slots being about 180 degrees apart.

Another aspect of the invention is a shaped charge comprising a case having on open front end, an external surface and a longitudinal axis; explosive material disposed in the case, the case including at least one opening extending from the external surface to the explosive material for initiation of the explosive material; and a liner disposed over the explosive material, all transverse cross-sections of the liner being bi-symmetric, at least one transverse cross-section having a liner thickness that varies.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Conventional shaped charges (or perforators) are initiated from a single point at the rear of the warhead and are designed to produce a round axi-symmetric jet. If two initiation points are used, a fan-like jet can be produced. However, a fan-jet can also be produced with single point initiation and without altering the normal initiation hardware. This is done by using a bi-symmetric shaped charge liner or a bi-symmetric shaped charge case.

Figure 1A:
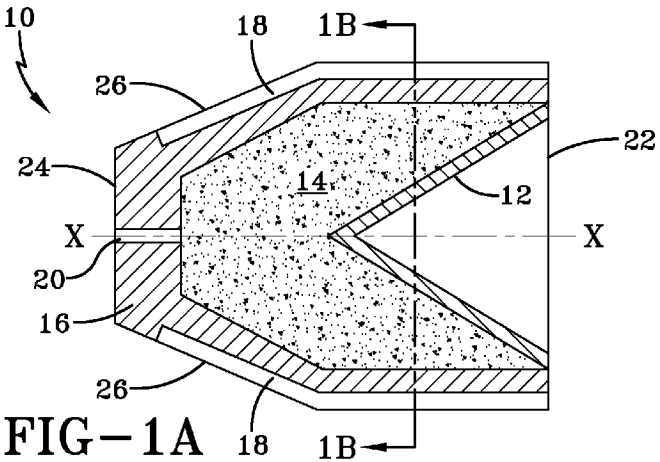
FIG. 1A is a side sectional view of one embodiment of a shaped charge.
Figure 1B:
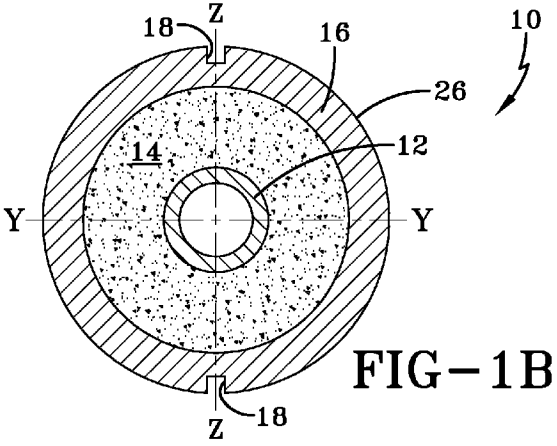
FIG. 1B is a sectional view along the line 1B-1B of FIG. 1.

A first aspect of the invention relates to shaped charges with bi-symmetric cases. FIG. 1A is a side sectional view of one embodiment of a shaped charge 10. FIG. 1B is a sectional view along the line 1B-1B of FIG. 1. Shaped charge 10 includes a case 16 having an open front end 22, an external surface and a longitudinal axis X-X. Explosive material 14 is disposed in the case 16. At least one opening 20 extends from the external surface of the case 16 to the explosive material 14 for initiation of the explosive material 14. A liner 12 is disposed over the explosive material 14. A pair of substantially identical longitudinal slots 18 are formed on the external surface of the case 16. The longitudinal slots 18 are spaced about 180 degrees apart.

All transverse cross-sections (i.e., taken in the manner of FIG. 1B) of the case 16 are bi-symmetric. Bi-symmetric means that a plane perpendicular to the section of FIG. 1B and passing through line Z-Z (where line Z-Z bisects the slots 18) will produce two case halves that are mirror images of each other. In addition, bi-symmetric means that a plane perpendicular to the section of FIG. 1B and passing through line Y-Y (where line Y-Y is shifted 90 degrees from line Z-Z) will produce two case halves that are also mirror images of each other.

In general, case 16 and/or liner 12 may be shaped in any of a variety of ways, including, but not limited to conical, bi-conical, tulip, hemispherical, trumpet, bell-shaped, hyperboloid, hyperbolic-paraboloid and parabolic. As shown in FIG. 1A, case 16 may include a closed rear end 24 and side walls 26 wherein the pair of longitudinal slots 18 are formed in the side walls 26. Preferably, the at least one opening 20 extending from the external surface to the explosive material 14 is disposed on the longitudinal axis X-X of the case 16.

While rectangular slots are shown, slots 18 may comprise any shape. The cross-sections of slots 18 may be constant or may vary, although the pair of slots 18 will be substantially identical to each other, to maintain bi-symmetry. The depth, width and height of the slots 18 may be constant or may vary. The slots 18 may extend in a forward direction to front end 22, as shown in FIG. 1A, or may end short of the front end 22. The slots may extend all the way to the rear end of the case 16, or may stop short of the rear end, as shown in FIG. 1A.

Preferably, the liner 12 is axi-symmetric about the longitudinal axis X-X of the case 16. This means that for any transverse cross-section of the liner 12, the liner thickness will be constant, in that cross-section. Of course, the liner thickness may vary in the longitudinal direction as long as the liner 12 is axi-symmetric about the axis X-X.

Figure 1C:
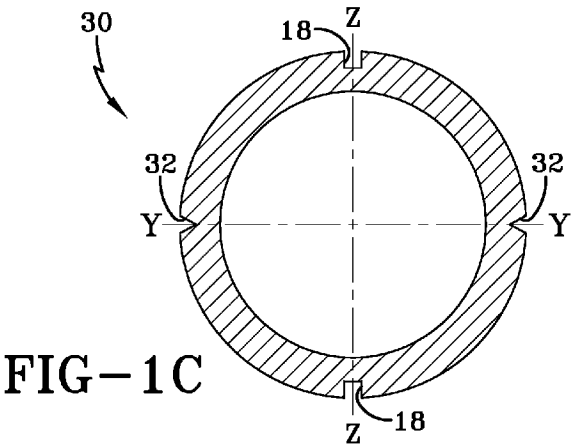
FIG. 1C is a sectional view of another embodiment of a shaped charge case.

FIG. 1C is a sectional view of another embodiment of a shaped charge case 30. FIG. 1C is similar to FIG. 1B but only the case 30 is shown. Case 30 includes slots 18 as described with reference to FIG. 1B. Case 30 also includes a second pair of substantially identical longitudinal slots 32 formed in the external surface of the case 30. The second pair of longitudinal slots 30 are about 180 degrees apart and are about 90 degrees offset from the pair of longitudinal slots 18.

While generally V-shaped slots 32 are shown, slots 32 may comprise any shape. The cross-sections of slots 32 may be constant or may vary, although the pair of slots 32 will be substantially identical to each other, to maintain bi-symmetry. For example, a portion of slot 32 may include a rectangular cross-section, as shown in slot 18. The depth, width and height of the slots 32 may be constant or may vary. The slots 32 may extend in a forward direction to front end 22 or may end short of the front end 22. The slots 32 may extend all the way to the rear end of the case 16, or may stop short of the rear end. It is noted that case 30 is bi-symmetric about axes Z-Z and Y-Y.

Figure 1D:
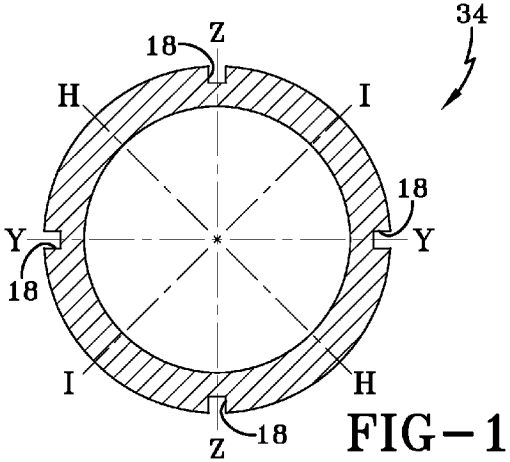
FIG. 1D is a sectional view of another embodiment of a shaped charge case.

FIG. 1D is a sectional view of another embodiment of a shaped charge case 34. Case 34 has four slots 18 that are substantially identical to each other. The form of slots 18 may vary as described before. Slots 18 are spaced about 90 degrees apart. Case 34 is symmetrical about axes Y-Y and Z-Z. Axes H-H and I-I are offset about 45 degrees from axes Y-Y and Z-Z. Case 34 is also symmetric about axes H-H and I-I. Thus, case 34 is quad-symmetrical.

The shaped charge 10 is preferably initiated along the center axis X-X. As the detonation wave moves forward, the liner 12 is preferentially collapsed due to the bi-symmetric case 16, producing a jet profile that will cut a slotted hole through the well casing, cement sheath and rock formation.

Figure 2A:
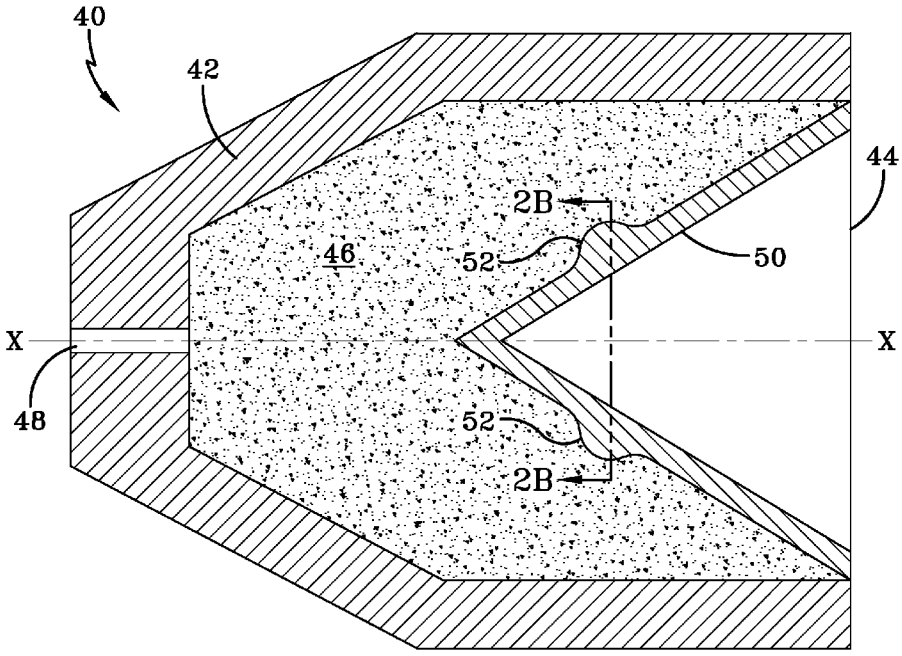
FIG. 2A is a side sectional view of one embodiment of a shaped charge.
Figure 2B:
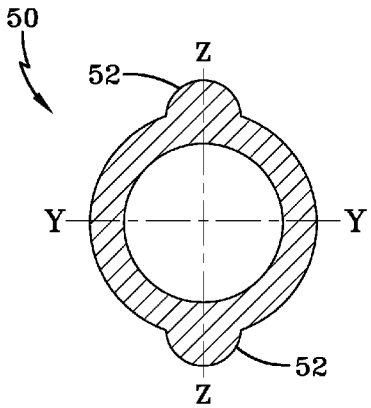
FIG. 2B is a sectional view along the line 2B-2B of FIG. 1.

A second aspect of the invention relates to shaped charges with bi-symmetric liners. FIG. 2A is a side sectional view of one embodiment of a shaped charge 40. FIG. 2B is a sectional view along the line 2B-2B of FIG. 2A, showing only the liner. Shaped charge 40 includes a case 42 having an open front end 44, an external surface and a longitudinal axis X-X. Explosive material 46 is disposed in the case 42. At least one opening 48 extends from the external surface of the case 42 to the explosive material 46 for initiation of the explosive material 46. The at least one opening 48 is preferably disposed on the longitudinal axis X-X. A liner 50 is disposed over the explosive material 46.

The shaped charge 40 is preferably initiated along the center axis X-X. As the detonation wave moves forward, the liner 50 is preferentially collapsed due to its bi-symmetry, producing a jet profile that will cut a slotted hole through the well casing, cement sheath and rock formation.

FIG. 2B shows one transverse cross-section of liner 50. All transverse cross-sections of the liner 50 are substantially bi-symmetric. That is, planes that are perpendicular to the cross-section and that intersect either axis Y-Y or Z-Z will bisect the cross-section into two halves that are mirror images of each other. At least one of the transverse cross-sections has a liner thickness that varies within the cross-section. FIG. 2B shows an example of a transverse cross-section with a varying liner thickness.

In FIG. 2B, the transverse cross-section of the liner 50 is generally annular and includes a pair of substantially identical increased thickness portions 52 located substantially 180 degrees apart. FIG. 2B is exemplary only, differently shaped cross-sections and differently shaped increased thickness portions are within the scope of the invention, as long as the section is bi-symmetric.

Figure 2C:
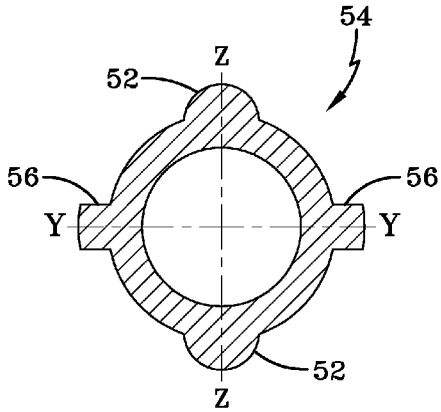
FIG. 2C is a sectional view of another embodiment of a liner.

FIG. 2C is a sectional view of another embodiment of a liner 54. Liner 54 includes the increased thickness portions 52 of FIG. 2B and also a second pair of substantially identical increased thickness portions 56 located substantially 180 degrees apart. The second pair of increased thickness portions 56 are about 90 degrees offset from the pair of increased thickness portions 52. The second portions 56 in FIG. 2C are generally rectangular, but other shapes may be used. The liner section of FIG. 2C is bi-symmetric about the Z-Z and Y-Y axes.

In the special case where the portions 52 and portions 56 are all substantially identical to each other, then the cross-section is quad-symmetric about the axes Y-Y, Z-Z and the pair of axes that are 45 degrees offset from Y-Y and Z-Z.

Preferably, the case 42 is axi-symmetric about the longitudinal axis X-X. In general, case 42 and/or liner 50 may be shaped in any of a variety of ways, including, but not limited to conical, bi-conical, tulip, hemispherical, trumpet, bell-shaped, hyperboloid, hyperbolic-paraboloid and parabolic.

The inventive shaped charges generate fan-like jets that produce slotted holes in rock formations. In the case of bi-symmetric liners, a simple change to the press punches used for manufacturing liners allows the fabrication and loading of bi-symmetric liners with existing perforator cases on existing production equipment, all with a minimal additional cost burden. For bi-symmetric cases, minimal additional manufacturing is required to produce a slotting perforator that is capable of using existing initiation hardware.

While the invention has been described with reference to certain preferred embodiments, numerous changes, alterations and modifications to the described embodiments are possible without departing from the spirit and scope of the invention as defined in the appended claims, and equivalents thereof.

The invention claimed is:

1. A shaped perforating charge for initiating flow from a well, comprising:

a case having a front portion with an open front end and a rear portion, an external surface and a longitudinal axis, all transverse cross-sections of the case being bi-symmetric;

said rear portion shaped in the form of a truncated cone with an open front, wherein the truncation of the cone forms said closed flat end of said case, said closed flat end being parallel to the open front end of said front portion, and wherein said closed flat end has a thickness greater than the thickness of the remainder of the cone;

said front portion being in the form of a cylinder, said cylinder having a front end and back end, said back end being continuously joined to the open front of said rear portion, wherein the cylinder has a thickness equal to the part of the front end of said rear portion to which it is joined;

said front end of said cylinder forming said open front end of said front portion, wherein said open front end is disposed in a plane which is substantially perpendicular to said longitudinal axis;

an explosive material disposed in the case, the case including a single ignition point formed by an opening within said closed flat end, extending from the external surface thereof to the explosive material for initiation of the explosive material, said opening being disposed symmetrically about said longitudinal axis; and a liner disposed within said open front end, over the explosive material, the liner being conical in shape, wherein the apex of said conical shape is aligned with the longitudinal axis of said case and pointing towards said flat end of said case;

wherein a pair of substantially identical longitudinal slots are formed on the external surface, the longitudinal slots being about 180 degrees apart;

whereby when the explosion is initiated, a fan-like jet will result.

2. The shaped perforating charge of claim 1 further comprising a second pair of substantially identical longitudinal slots formed in the external surface, the second pair of longitudinal slots being about 180 degrees apart.

3. The shaped perforating charge of claim 1 wherein the second pair of longitudinal slots are about 90 degrees offset from the pair of longitudinal slots.

4. The shaped perforating charge of claim 3 wherein the pair of longitudinal slots and the second pair of longitudinal slots are substantially identical and the case is quad-symmetrical.

5. A method of perforating a well, comprising:

providing at least one shaped charge of claim 1; and perforating the well using the at least one shaped charge.

6. The shaped perforating charge of claim 1, wherein the shape of said liner is selected from the group consisting of bi-conical, tulip, trumpet, bell-shaped, hyperboloid, hyperbolic-paraboloid, and parabolic.

* * * * *